US005699978A

United States Patent [19]

Hanazawa

[11] Patent Number: 5,699,978

[45] Date of Patent: Dec. 23, 1997

[54] TEAR TAPE CHANGER

[75] Inventor: Yuji Hanazawa, Chiba-ken, Japan

[73] Assignee: Tokyo Automatic Machinery Works, Ltd., Tokyo, Japan

[21] Appl. No.: 684,053

[22] Filed: Jul. 22, 1996

[51] Int. Cl.[6] ..... B65H 19/14; B65H 21/00; B65H 23/00; B65H 19/18

[52] U.S. Cl. ..... 242/552; 242/554.2; 242/556.1; 242/563.2; 242/566

[58] Field of Search ..... 242/552, 554.2, 242/556.1, 563.2, 566

[56] References Cited

U.S. PATENT DOCUMENTS

| | | | |
|---|---|---|---|
| 3,645,463 | 2/1972 | Helin | 242/554.2 X |
| 4,222,533 | 9/1980 | Pongracz | 242/554.4 |
| 4,848,691 | 7/1989 | Muto et al. | 242/553 |
| 4,984,750 | 1/1991 | Shigeta et al. | 242/553 |
| 5,411,223 | 5/1995 | Gatteschi | 242/552 X |

FOREIGN PATENT DOCUMENTS

| | | |
|---|---|---|
| 0009004 | 3/1980 | European Pat. Off. . |
| 0662437 | 7/1995 | European Pat. Off. . |
| 0703149 | 3/1996 | European Pat. Off. . |
| 4205343 | 3/1992 | Germany . |
| 3-30246 | 6/1991 | Japan . |
| 3-30249 | 6/1991 | Japan . |
| 2253203 | 9/1992 | United Kingdom . |

OTHER PUBLICATIONS

A Foreign Patent Office Communication.

*Primary Examiner*—John Q. Nguyen
*Attorney, Agent, or Firm*—Greenblum & Bernstein P.L.C.

[57] ABSTRACT

A tear tape changer, in which guide rollers positioned at downstream ends of two transfer paths are disposed displacedly from each other in the front and rear direction orthogonal to a tape feed direction to prevent mutual interference of tapes even when the tapes are stretched crosswise from the guide rollers toward two route changing rollers. After the tape stretched on the route changing roller which is standing by in a stand-by position has been fed to a backup roller with an approaching motion of a pressure roller to the backup roller, the route changing roller is moved to a feed position. At the same time, the route changing roller which is standing by in the feed position and which is in an empty state is moved in the rear direction by a relief means while moving it to the stand-by position. As a result, the empty route changing roller returns to the stand-by position without interference with the tape which is stretched on the other route changing roller and which is in use, thus permitting the tape to be stretched on the pressure roller.

11 Claims, 7 Drawing Sheets

TEAR TAPE CHANGER

TECHNICAL FIELD OF THE INVENTION

The present invention relates to a tear tape changer for bonding a tear tape to a packaging film formed of, for example, cellophane or polypropylene, such as a tobacco packaging film or a cased article packaging film, in which the tear tape is put on the packaging film in a predetermined position and then the film and the tear tape are fed toward a heat-bonding device. More particularly, the invention is concerned with a tear tape changer wherein transfer paths each with a cutter disposed therein are formed on downstream sides of two tape reels mounted removably, and on downstream sides of the said transfer paths are disposed a backup roller for putting the tape fed from one of the transfer paths and a packaging film fed along a film feed path one upon the other and conducting the two to a downstream side, and a pressure roller for removably holding the front end of the tape fed from the other transfer path and allowing it to stand by. When the tape from one of the two transfer paths is about to be used up, the other stand-by tape is connected to the preceding tape by approaching of both pressure roller and backup roller in accordance with the result of detection of a residual tape quantity, and in this way tapes are fed to the film feed path successively in an alternate manner.

BACKGROUND ART

According to a conventional tear tape changer of this type, for example as disclosed in Japanese Utility Model Publication No. Hei 3-30246, a backup roller and a pressure roller, two in all, are disposed at a downstream end of each of two transfer paths, and when the tear tape changer is in operation wherein tape is fed from one of the two transfer paths to a film feed path and when a detector has detected only a small residual amount of the tape being used, the tape is cut with a cutter, while at the same time a replacement tape preset in the other transfer path is fed to the film feed path by approaching of both pressure roller and backup roller. At this time, the tape reel of the tape which has been used up is replaced with a tape-loaded reel, and in this way the tapes from the two transfer paths are fed to the film feed path successively in an alternate manner.

In such conventional tear tape changer, however, since two backup roller and pressure roller are disposed at the downstream end of each of the two transfer paths, there arises the problem that not only the size of the tear tape changer becomes so much larger but also the structure thereof becomes complicated, thus leading to an increase of cost.

In the case where an adhesive such as a hot melt adhesive is applied beforehand to a packaging film and then tape is bonded thereto, there arises the problem that the adhesive solidifies and cannot bond the tape to a satisfactory extent because the position where the adhesive is applied to the packaging film and the tape bonding position are spaced apart from each other.

DISCLOSURE OF THE INVENTION

Accordingly, it is the object of the present invention to provide a tear tape changer wherein the tapes from two transfer paths can be connected and fed successively in an alternate manner without interference by means of one backup roller and one pressure roller and wherein an adhesive applying position to a packaging film and a tape bonding position can be set close to each other.

In order to achieve the above-mentioned object the present invention is characterized in that:

guide rollers positioned at downstream ends of two transfer paths are disposed displacedly from each other in a front and rear direction orthogonal to a tape feed direction;

between the guide rollers and a pair of backup roller and pressure roller disposed downstream of the guide rollers there are disposed a route changing roller standing by in a feed position where the tape from the downstream end of one transfer path is stretched around the route changing roller toward the backup roller, and a route changing roller standing by in a stand-by position where the tape from the downstream end of the other transfer path is stretched around the route changing roller toward the pressure roller; and that there are provided a drive unit which, after the tape stretched around the route changing roller standing by in the stand-by position has been fed to a film feed path by a mutual approaching motion of the pressure roller and the backup roller, causes the said route changing roller to move to its feed position and causes the route changing roller standing by in the feed position to move to its stand-by position; and a relief means whereby only the route changing roller which moves from its feed position to its stand-by position is moved in a rear direction orthogonal to the tape feed direction so as not to interfere with the tape being used.

The drive unit causes the rotative movement of the two route changing rollers, and the relief means is preferably a fixed cam with which followers connected to the route changing rollers come into abutment.

In the above construction, the guide rollers positioned at the downstream ends of the two transfer paths are disposed displacedly in the front and rear direction orthogonal to the tape feed direction, so even when the tapes are stretched crosswise from the guide rollers toward the two route changing rollers, both are prevented from interfering with each other. After the tape stretched around the route changing roller Standing by in its stand-by position has been fed to the backup roller by an approaching motion of the pressure roller, this route changing roller is moved to its feed position, while the route changing roller standing by in its feed position, which roller is in an empty state, is moved to its stand-by position while being moved backward by the relief means, whereby the route changing roller which is in an empty state returns to its stand-by position without interference with the tape in use stretched onto the other route changing roller. Now the tape for replacement can be stretched onto the pressure roller.

Thus, the tapes from the transfer paths can be connected and fed successively in an alternate manner without interference by means of one backup roller and one pressure roller. Besides, the position where an adhesive is applied to the packaging film and the tape bonding position can be drawn close to each other. Therefore, in comparison with the conventional construction wherein two rollers—backup roller and pressure roller—are disposed at each of the downstream ends of two transfer paths, it is possible to so much simplify the structure and decrease the cost. Besides, also in the case where an adhesive such as a hot melt adhesive is applied beforehand to the packaging film for the bonding of tape thereto, it is possible to effect the bonding before solidifying of the adhesive because the conveyance distance becomes shorter.

DESCRIPTION OF EMBODIMENT

An embodiment of the present invention will be described hereinunder with reference to the accompanying drawings.

Figure 1:
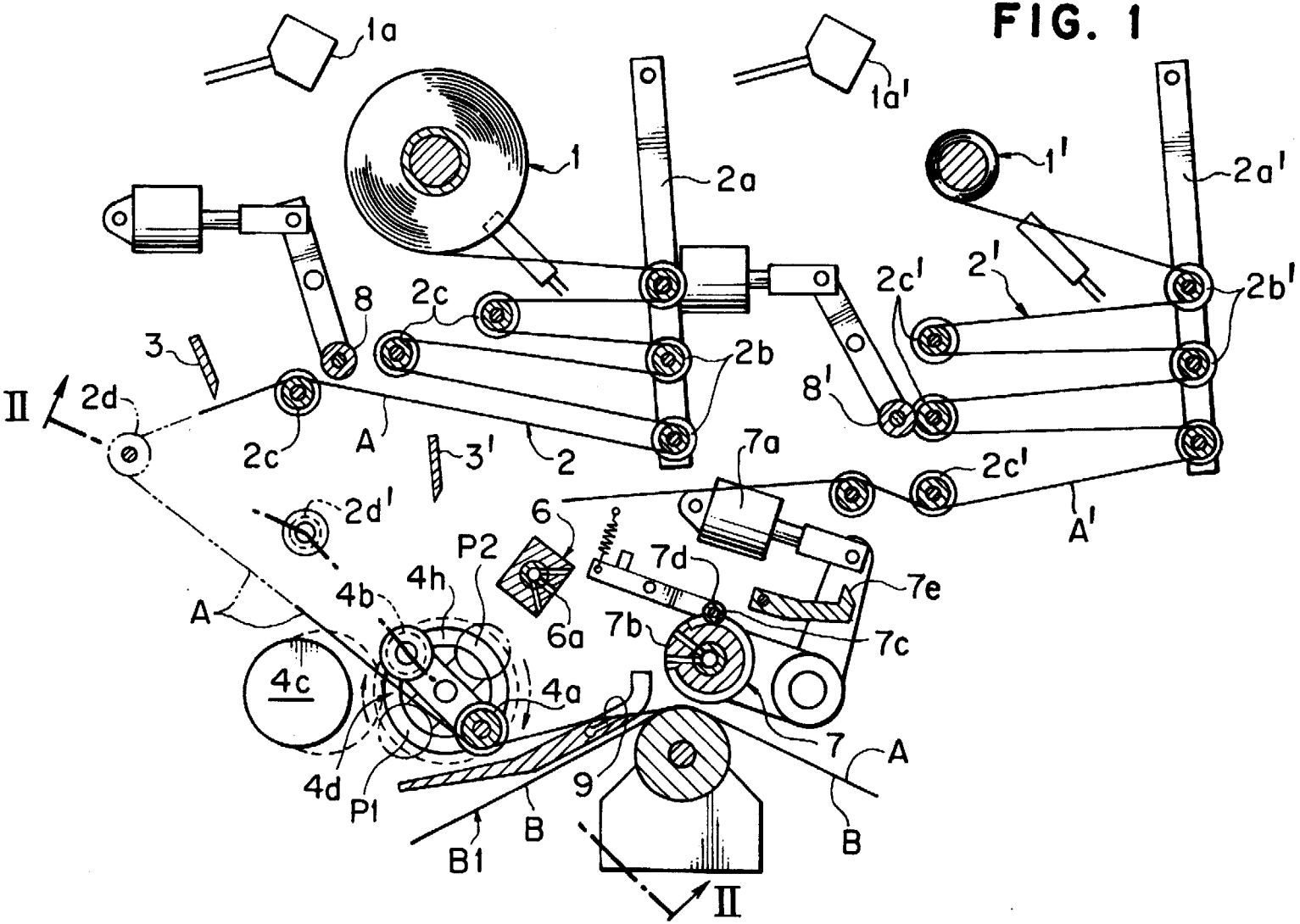
FIG. 1 is a front view in longitudinal section of a tear tape changer according to an embodiment of the present invention, showing a state in which tape passing routes are being changed from one to the other.

As illustrated in FIG. 1, like the structure disclosed in Japanese Utility Model Publication No. Hei 3-30249, transfer paths 2, 2' for tapes A, A' are formed downward substantially in parallel with each other on downstream sides of two tape reels 1, 1' mounted removably, the transfer paths 2, 2' each comprising a plurality of movable guide rollers 2*b* . . . , (2*b*' . . . ) mounted on a tension lever 2*a*, (2*a*') and a plurality of fixed guide rollers 2*c* . . . (2*c*' . . . ). At the most downstream ends of the transfer paths 2, 2' are fixedly disposed guide rollers 2*d*, 2*d*' close to each other on the left-hand side in the front. Further, between the guide rollers 2*d*, 2*d*' and the fixed guide rollers 2*c*, 2*c*' positioned on the most downstream sides of the respective transfer paths are disposed cutters 3, 3' so that they can pop in and out. When a detector 1*a* (1*a*') for detecting a residual amount of the tape on the tape reel 1 (1') has detected that only a small amount of the tape A (A') in use remains on the tape reel 1 (1'), the cutter 3 (3') is ejected to cut the tape A (A') simultaneously with or a little later than the said detection.

The downstream ends of the transfer paths 2, 2', in other words, the guide rollers 2*d*, 2*d*' located at the most downstream ends, are displaced from each other in the front and rear direction orthogonal to the tape feed direction, namely orthogonal to the transfer paths 2, 2' exclusive of the guide rollers 2*d*, 2*d*'.

Figure 2:
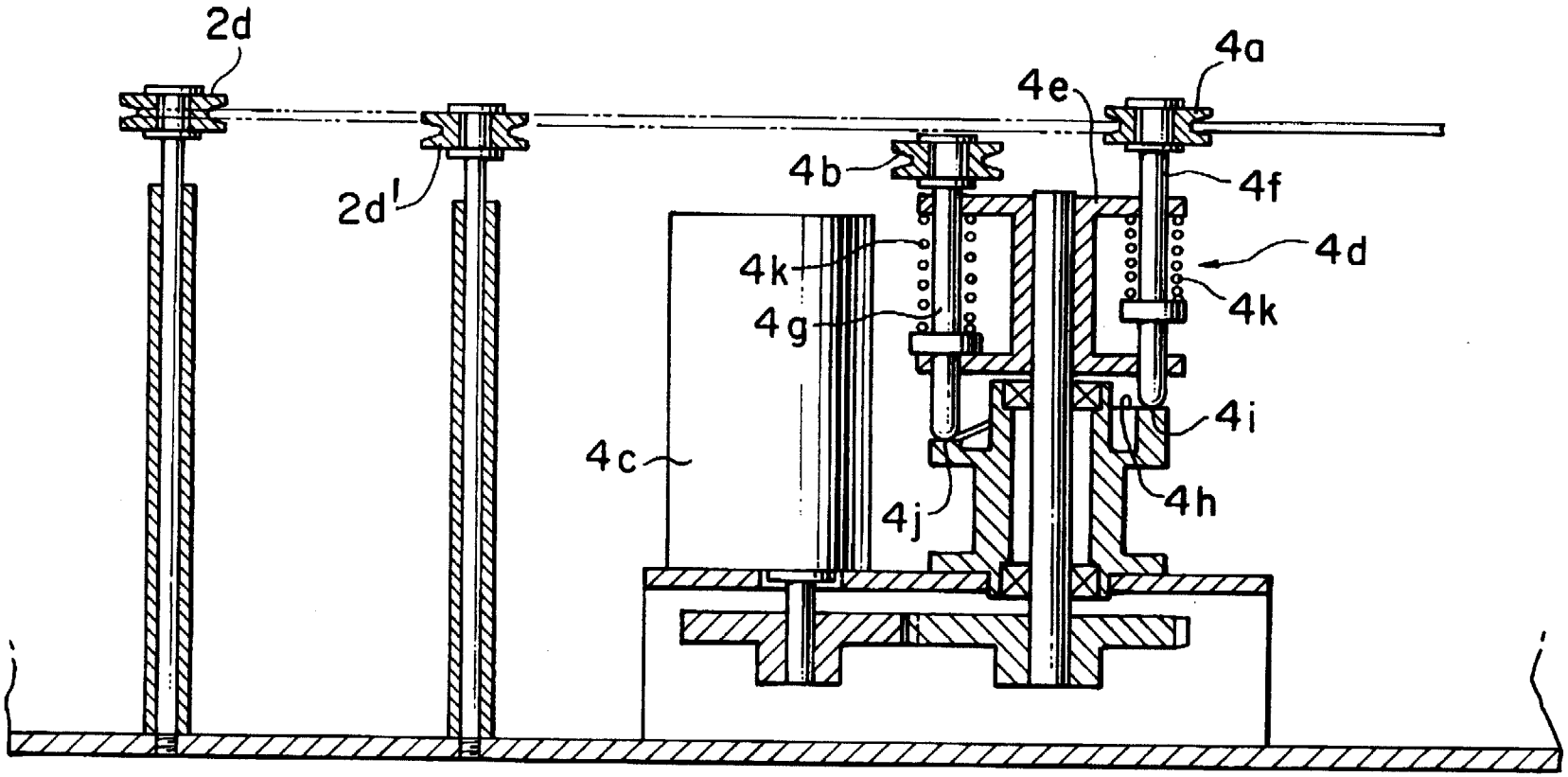
FIG. 2 is a partial enlarged bottom view in transverse section taken along line (II)—(II) in FIG. 1.

In this embodiment, as shown in FIGS. 1 and 2, the guide roller 2*d* located at the most downstream end of the left-hand transfer path 2 when seen in front view is displaced forward, while the guide roller 2*d*' located at the most downstream end of the right-hand transfer path 2' in front view is displaced backward, so that even when the tapes A, A' from the guide rollers 2*d*, 2*d*' are stretched crosswise toward two route changing rollers 4*a*, 4*b* which will be described later, both tapes do not interfere with each other.

Further downstream of the guide rollers 2*d*, 2*d*' located at the most downstream ends are disposed two route changing rollers 4*a*, 4*b* in downward positions on the right-hand side in front view, and still further downstream of those route changing rollers are disposed a backup roller 5 and a pressure roller 7 vertically through a tape holder 6 on the right-hand side in front view.

The two route changing rollers 4*a*, 4*b* are integrally provided each for free rotation in such a manner that for example when one route changing roller stands by in a feed position P1, the other route changing roller stands by in a stand-by position P2 on the side opposite to the feed position P1. Either the tape A or A' fed from either the transfer path 2 or 2' is stretched onto the route changing roller standing by in the feed position P1 and toward backup roller 5, while the other tape is stretched onto the other route changing roller standing by in the stand-by position P2 and toward both tape holder 6 and pressure roller 7.

After the tape A or A' stretched onto one route changing roller 4*a* or 4*b* standing by in the stand-by position P2 has been fed to a film feed path B1 with approach of the pressure roller 7 and the backup roller 5 which will be described later, the roller 4*a* or 4*b* is moved to the feed position P1, while at the same time the other route changing roller standing by in the feed position P1 is moved to the stand-by position P2. This is done by means of a drive unit 4*c*. Also provided is a relief means 4*d* which causes the route changing roller being moved from the feed position P1 to the stand-by position P2 to move in the backward direction orthogonal to the tape feed direction so as to avoid interference thereof with the tape A or A' which is in use.

In this embodiment, as shown in FIG. 2, the drive unit 4*c* is constituted, for example, by a motor whose operation is controlled with a timer which operates in accordance with detected signals provided from the detectors 1*a* and 1*a*'. The drive unit 4*c* is connected to a rotary member 4*e* which is supported rotatably in the tape feed direction. In positions spaced the same distance from the axis of the rotary member 4*e* are mounted rods 4*f* and 4*g* on which 4*a*, 4*b* are provided for free rotation reciprocatably in the front and rear direction orthogonal to the tape feed direction, whereby upon lapse of a predetermined time after an approaching motion of both pressure roller 7 and backup roller 5 to be described later, more specifically after the tape A or A' which has been standing by was delivered to the downstream side with respect to the backup roller 5, the route changing rollers 4*a* and 4*b* are moved rotatively in the tape feed direction through the rotary member 4*e* and the rods 4*f*, 4*g*.

The relief means 4*d* comprises a fixed cam 4*h*, e.g. end cam, followers 4*i* and 4*j* connected to the rear ends of the rods 4*f* and 4*g*, respectively, in opposed relation to the fixed cam 4*h*, and resilient members 4*k*, 4*k*, e.g. springs, interposed between the rods 4*f*, 4*g* and the rotary member 4*e* for urging the followers 4*i* and 4*j* against the fixed cam 4*h* at all times.

The backup roller 5 may be of such a structure as disclosed in Japanese Utility Model Publication No. Hei 3-30249 wherein the roller is connected to a motor (not shown) and is thereby rotated so that its peripheral speed becomes equal to the feed rate of a packaging film B. Alternatively, it may be a rotatable roller for guiding the packaging film B which is fed from another feed means disposed on the downstream side. One of the tapes A and A' fed from the transfer paths 2 and 2' is laminated to the packaging film B fed along the film feed path B1 and in this state both film and tape are fed toward a heat-bonding device (not shown) for heat-bonding the two disposed and a printer (not shown) for printing necessary characters such as the best-before period on the packaging film B which are disposed further downstream.

As the tape holder 6 there is adopted the same structure as in Japanese Utility Model Publication No. Hei 3-30249 wherein a suction surface 6*a* is provided in opposed relation to the other tape A or A' fed from the transfer path 2 or 2', which tape is held removably with the suction force provided from the suction surface 6*a*.

As the pressure roller 7 there is used a roller of the same structure as that disclosed in Japanese Utility Model Publication No. Hei 3-30249. According to this structure, the pressure roller 7 is disposed reciprocatably in contacting and leaving directions with respect to the backup roller 5 by connection thereof with a drive source 7*a* such as an air cylinder which operates in accordance with detected signals provided from the detectors 1*a* and 1*a*'. Its outer peripheral surface is formed with a suction surface 7*b* comprising a plurality of suction holes, and a retaining plate having a cutout 7*c* for fitting therein of a stopper roller 7*d* is integrally provided projectingly, whereby when the pressure roller 7 is in a position spaced away from the backup roller 5, the cutout 7*c* is brought into engagement with the stopper roller 7*d* to inhibit the rotation of the pressure roller 7 so that the suction surface 7*b* is positioned on the tape holder 6 side, while when the pressure roller 7 contacts the backup roller 5 and turns, the stopper roller 7*d* becomes disengaged from the cutout 7*c* to permit free rotation of the pressure roller 7.

Then, upon lapse of a predetermined time after projection of either the cutter 3 or the cutter 3', the pressure roller 7 approaches and contacts the backup roller 5 and turns thereby.

According to this embodiment, moreover, in positions opposed to one of the fixed guide rollers 2*c* . . . , and one of the fixed guide rollers 2*c*' are respectively disposed reverse rotation preventing rollers 8 and 8' each containing a reverse rotation preventing mechanism such as a one-way clutch. Just after the tape A (A') has been cut by the cutter 3 (3'), the reverse rotation preventing roller 8 (8') is brought into abutment with one of the fixed guide rollers 2*c* . . . (2*c*') to inhibit a violent swing motion of the tension lever 2*a* (2*a*') in the tape tension direction with cutting of the tape and thereby prevent spring-back of the end portion of the tape A, A'.

Above the stretched tape traveling route of the tape A (A') extending from one of the route changing rollers 4*a* and 4*b* standing by in the feed position P1 up to the backup roller 5 is disposed a suction means 9 which is a suction hole for example to hold by suction the end portion of the tape A (A') which has been cut by the cutter 3 (3'), thereby preventing meandering of the tape.

For some particular type of a packaging film B there may be disposed, for bonding thereof with the tape A (A'), a device (not shown) for the application of an adhesive such as a hot melt adhesive on the upstream side of the film feed path B1.

The operation of the tear tape changer constructed as above will be described below.

Figure 3:
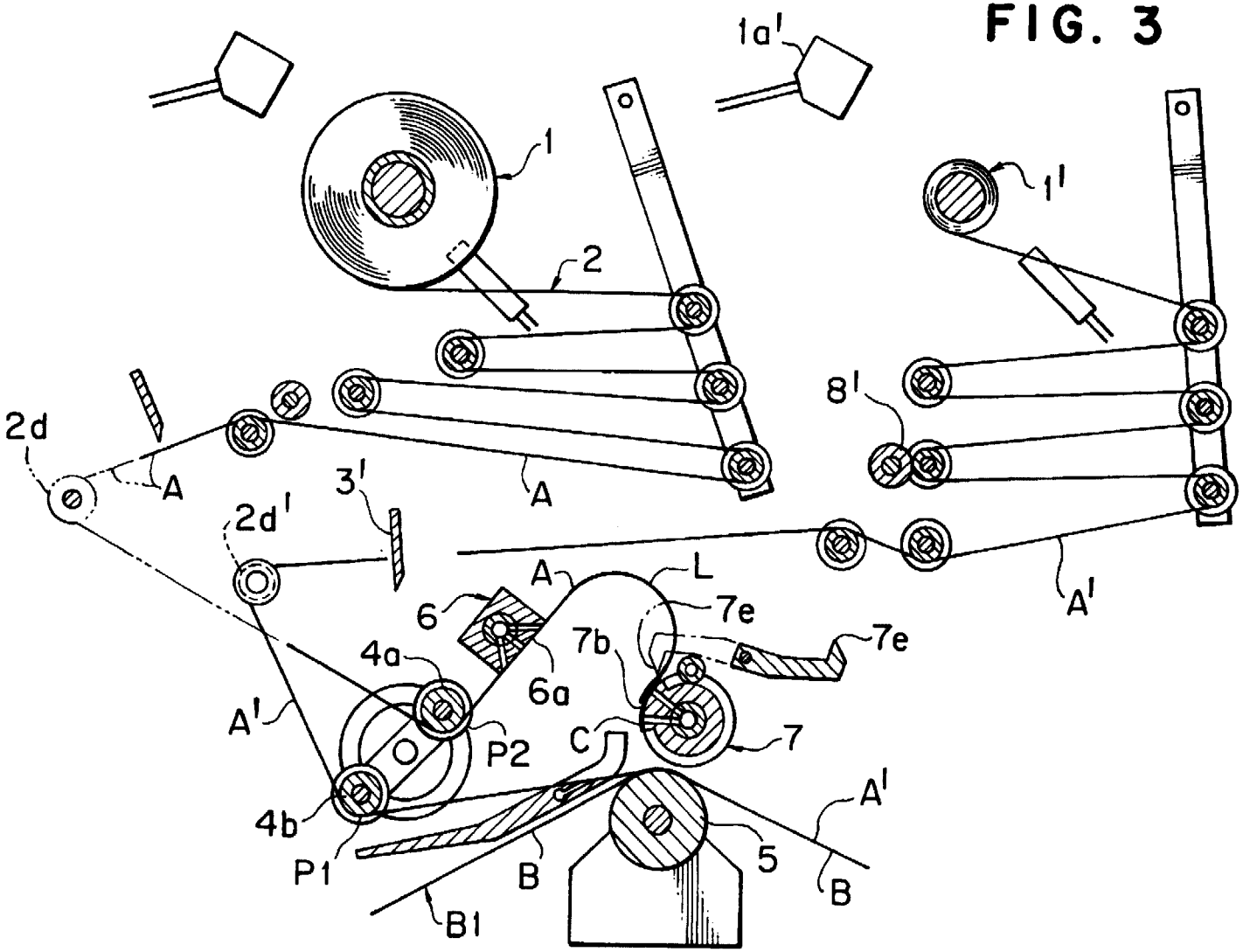
FIG. 3 is a front view in longitudinal section, showing a tape in use which is being cut.

First, the tape changing operation will be described assuming that the tape reel 1' on the right-hand side in front view is in use and that the tape reel 1 on the left-hand side in front view is for replacement, as shown in FIG. 3. From the tape reel 1 for replacement the tape A is drawn out manually along the transfer path 2 and is stretched via the guide roller 2*d* located at the most downstream end onto one of the route changing rollers 4*a* and 4*b* which is standing by in the stand-by position P2 and which is in an empty state. Thereafter, the tape A is held by suction on the suction surface 7*b* of the pressure roller 7 in a partially exposed state of an adhesive surface of an adhesive tape piece C affixed to the front end portion of the tape A. At the same time, with a slack portion L formed at an upstream portion of the tape A, the tape is held by suction on the suction surface 6*a* of the tape holder 6. Now, the preparation for tape replacement is over.

Accordingly, even if the tape A drawn out from the guide roller 2*d* located at the most downstream end is stretched crosswise with the tape A' which is in use, both tapes A and A' do not interfere with each other because the guide rollers 2*d* and 2*d*' are disposed displacedly from each other in the front and rear direction orthogonal to the tape feed direction, namely orthogonal to the transfer paths 2, 2' exclusive of the guide rollers 2*d*, 2*d*' located at the most downstream end.

In a completed state of the preparation for replacement, when the suction of the suction surface 7*b* of the pressure roller 7 is to be stopped for example at the end of work, a presser pawl 7*e* disposed near the pressure roller 7 presses and holds the adhesive tape piece C between it and the pressure roller to prevent dislodgement of the adhesive tape piece C, as indicated with a dot-dash line in FIG. 3.

When the detector 1*a*' produces a detected signal in response to a decrease in the amount of tape A' which is in use, the cutter 3' projects and cuts the tape A'.

Figure 4:
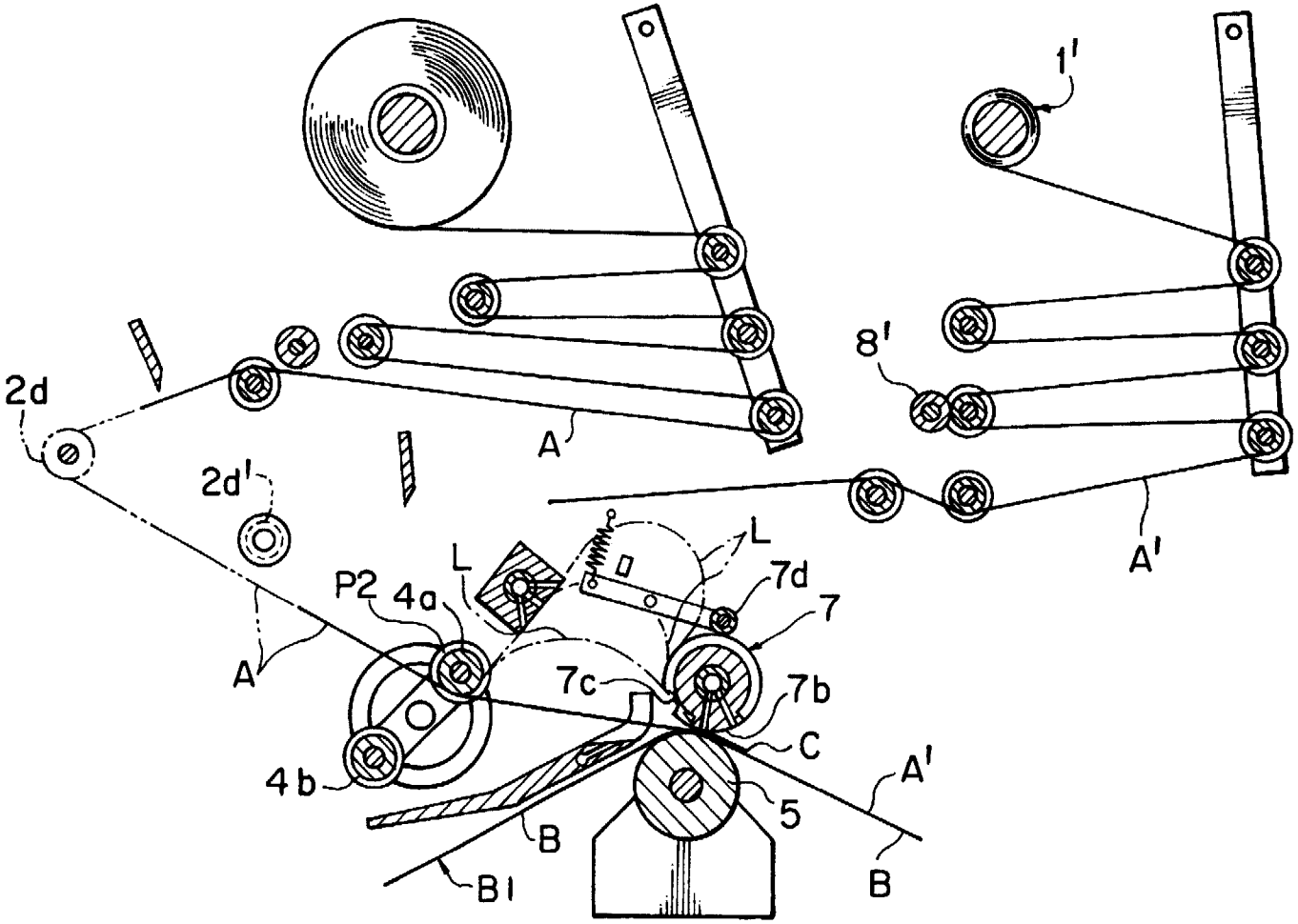
FIG. 4 is a front view in longitudinal section, showing the other tape being fed and connected to the preceding tape.

Later, when the pressure roller 7 approaches and contacts the backup roller 5, as shown in FIG. 4, it begins to rotate and presses the front end portion of the tape A held by suction on the suction surface 7*b* against the packaging film B present on the backup roller 5, whereby the adhesive tape piece C on that front end portion is affixed to the upper surface of the packaging film B so as to become connected to the terminal end portion of the tape A' which is in use.

Subsequently, with rotation of the backup roller 5, the tape A is delivered together with the packaging film B. As a result, the slack portion L diminishes gradually, and eventually the tape A extending from the route changing roller 4*a* standing by in the stand-by position P2 up to the backup roller 5 is stretched on a straight line.

Thereafter, as shown in FIGS. 1 and 2, the rotary member 4*e* begins to rotate under the operation of drive unit 4*c*, and the route changing roller 4*a* standing by in the stand-by position P2 moves toward the feed position P1, whereby the traveling route of the tape A is changed, and at the same time the empty route changing roller 4*b* standing by in the stand-by position P1 moves toward the stand-by position P2.

At this time, the follower 4*j* of the empty route changing roller 4*b* which is moving toward the stand-by position P2 comes into engagement with the fixed cam 4*h* of the relief means 4*d* and sinks backward, thereby preventing interference of the roller 4*b* with the tape A which is in use.

Figure 5:
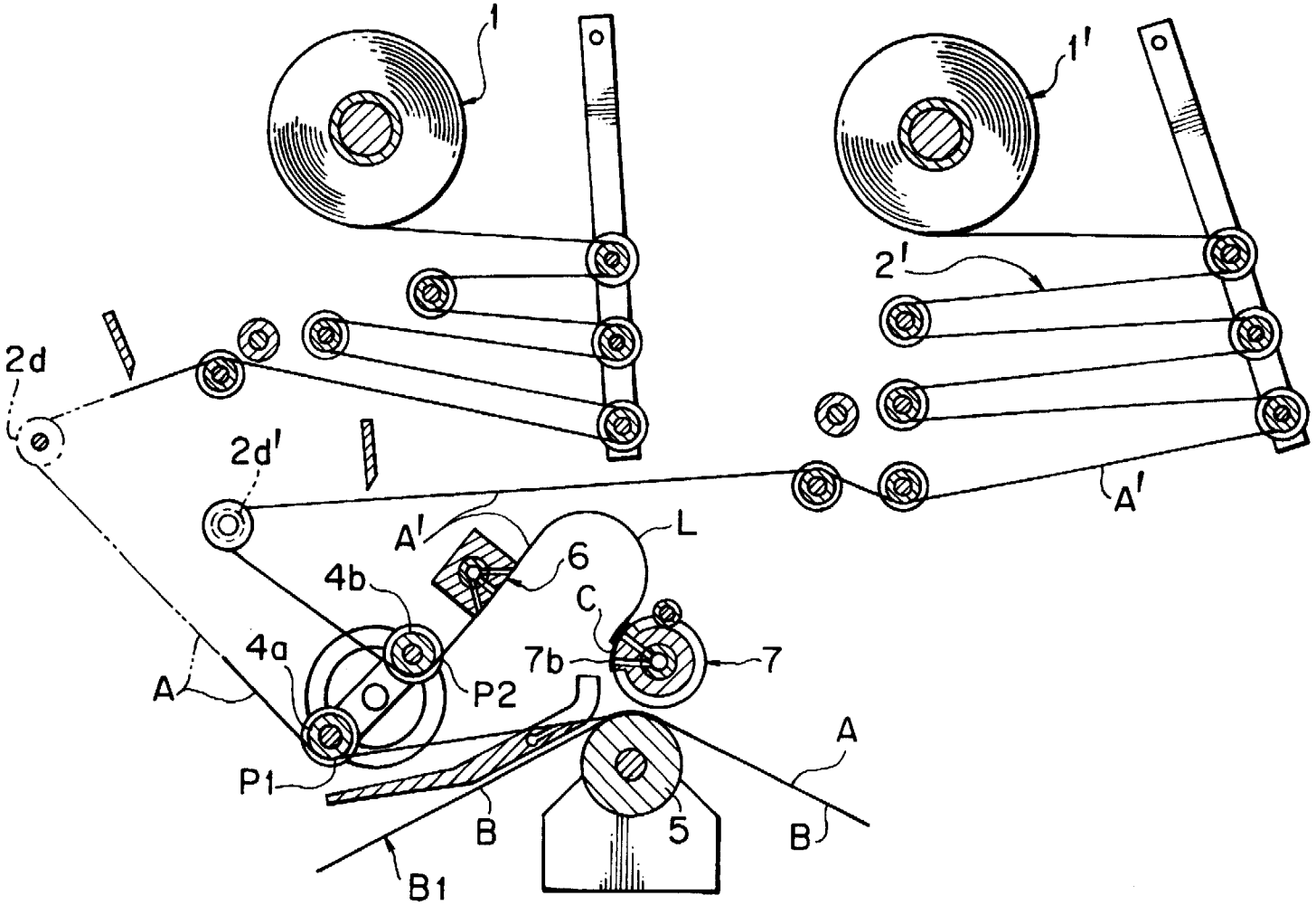
FIG. 5 is a front view in longitudinal section, showing a state after the tape replacement.

While the tape A is fed from the tape reel 1, the tape A' which has been cut is back-wound manually onto the right-hand tape reel 1' in front view, then when the movement of the route changing rollers 4*a* and 4*b* is over, there is made replacement of the tape reel 1'. Then, as shown in FIG. 5, tape A' is drawn out from the replacement tape reel 1' along the transfer path 2' and is stretched via the guide roller 2*d*' located at the most downstream end onto the empty route changing roller 4*b* standing by in the stand-by position P2. Thereafter, the adhesive tape piece C affixed to the front end portion of the tape A' is held by suction on the suction surface 7*b* of the pressure roller 7 to effect the preparatory work for tape replacement.

Figure 6:
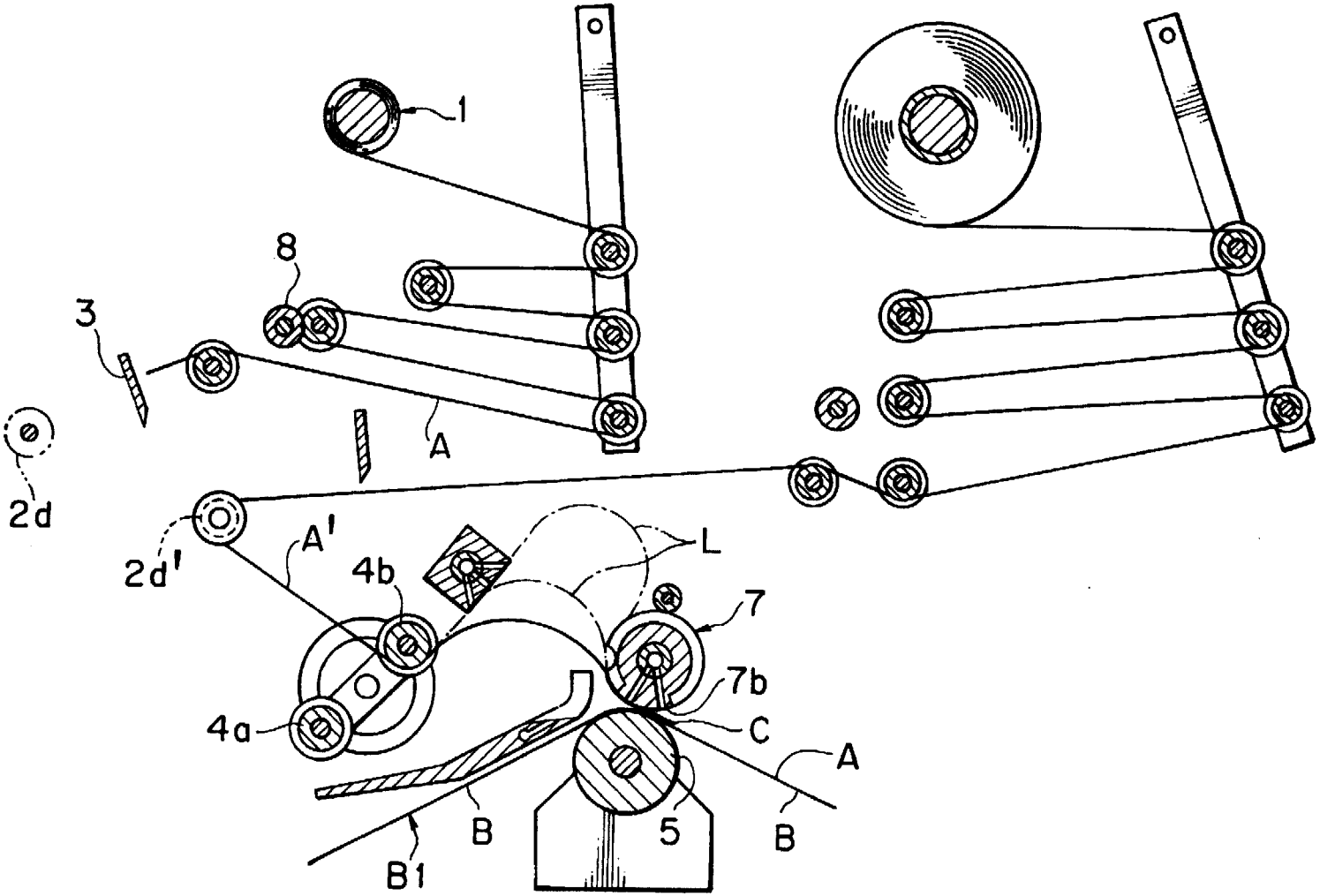
FIG. 6 is a front view in longitudinal section, showing tape connection and feed.

Thereafter, also when the cutter 3 has cut the tape A which is in use in response to a decrease in the residual amount of the tape A, as shown in FIG. 6, the pressure roller 7 approaches the backup roller 5 to feed the front end portion of the tape A' held by suction on the suction surface 7*b* onto the backup roller 5, in the same manner as above, whereby the adhesive tape piece C at the said front end portion is affixed to the upper surface of the packaging film B and connected to the terminal end portion of the tape A which is in use.

Figure 7:
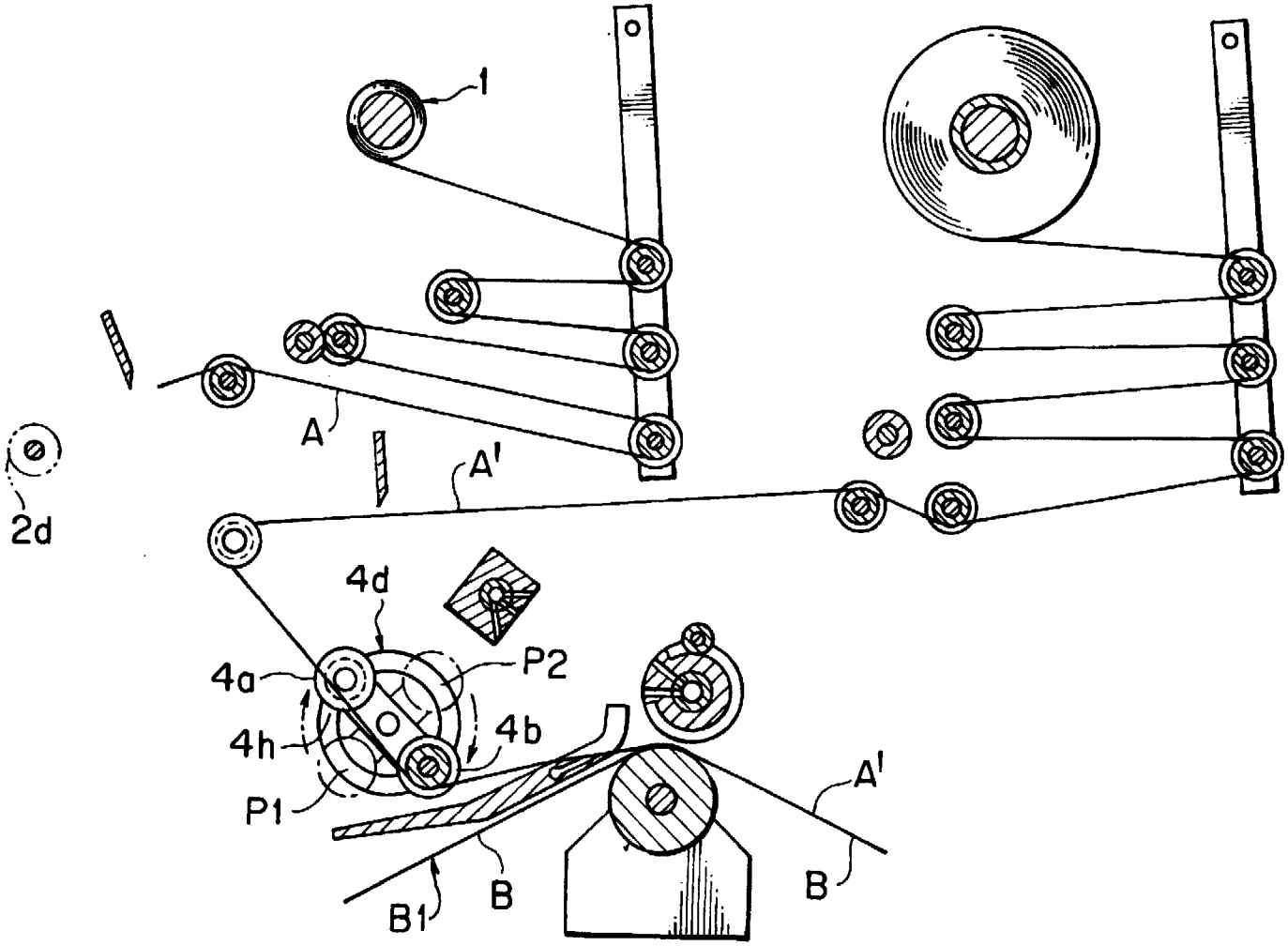
FIG. 7 is a front view in longitudinal section, showing tape passing routes being changed from one to the other.

Then, as shown in FIG. 7, the route changing roller 4*b* standing by in the stand-by position P2 moves toward the feed position P1 to change the traveling route of the tape A', and at the same time the empty route changing roller 4*a* standing by in the feed position P1 moves toward the stand-by position P2. But also in this case the empty roller 4*a* sinks backward under the operation of the relief means 4*d* to avoid interference thereof with the tape A' which is in use. Subsequently, the same operations as above are repeated to feed the tapes A and A' to the film feed path B1 successively in an alternate manner.

The structure of the relief means 4*d* is not limited to the above structure. The relief means 4*d* may be of any other structure if only either the route changing roller 4*a* or 4*b* moving from the feed position P1 to the stand-by position P2 can thereby move in the rear direction orthogonal to the tape feed direction so as to avoid interference thereof with the tape A or A' which is in use.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

I claim:

1. A tear tape changer wherein transfer paths of tapes with cutters disposed therein are formed downstream of two tape reels mounted removably, a backup roller for conducting the tape fed from one of the transfer paths and a packaging film fed along a film feed path to a downstream side in a superimposed state, and a pressure roller for removably holding a front end portion of the tape fed from the other transfer path and causing it to stand by, are disposed on downstream sides of the transfer paths, and when the tape from one of the transfer paths has been used up, the pressure roller and the backup roller are moved close to each other in accordance with a detected value of a residual amount of the tape to connect the other tape which is standing by to the one tape, thus allowing the tapes to be fed to the film feed path successively in an alternate manner, said tear tape changer comprising:

guide rollers disposed at the downstream ends of the two transfer paths, respectively, the guide rollers being displaced from each other in front and rear directions orthogonal to the tape feed directions;

a pair of backup roller and pressure roller disposed on the downstream side of the two guide rollers;

a route changing roller standing by in a feed position in which the tape from the downstream end of one of the transfer paths is stretched toward the backup roller, and a route changing roller standing by in a stand-by position in which the tape from the downstream end of the other transfer path is stretched toward the pressure roller, said route changing rollers are disposed between the guide rollers and the backup and pressure rollers;

a drive unit for moving the route changing roller standing by in the stand-by position to the feed position after the tape stretched on the route changing roller has been fed to the film feed path with an approaching motion of the pressure roller and the backup roller, and for moving the route changing roller standing by in the feed position to the stand-by position; and a relief means for moving only the route changing roller that is moving from the feed position to the stand-by position, in the rear direction orthogonal to the tape feed direction so as not to interfere with the tape which is in use.

2. A tear tape changer according to claim 1, wherein said drive unit is controlled to move the two route changing rollers rotatively.

3. A tear tape changer according to claim 2, wherein said drive unit is controlled to move the route changing rollers in the tape feed direction after the stand-by tape has been delivered to a downstream side with respect to the backup roller with an approaching motion of the pressure roller and the backup roller.

4. A tear tape changer according to claim 3, wherein said drive unit is a motor whose operation is controlled by a timer adapted to operate in accordance with detected values provided from detectors for detecting residual amounts of tapes on the tape reels.

5. A tear tape changer according to claim 1, wherein said relief means is a fixed cam with which followers connected to the route changing rollers come into abutment.

6. A tear tape changer according to claim 5, wherein said relief means comprises the fixed cam, the followers disposed in an opposed relation to the fixed cam, and resilient members for urging the followers toward the fixed cam at all times.

7. A tear tape changer according to claim 1, wherein said two transfer paths each comprise a plurality of movable guide rollers mounted on a tension lever and a plurality of fixed guide rollers opposed to the movable guide rollers, and reverse rotation preventing rollers each containing a reverse rotation preventing mechanism are disposed each in opposition to one of the fixed guide rollers so as to be reciprocatable in contacting and leaving directions with respect to the one fixed guide roller respectively to inhibit violent swing motions of the tension levers in the direction of tape tension upon tape cutting, thereby preventing spring-back of an end portion of the cut tape.

8. A tear tape changer according to claim 1, further comprising a suction means for holding by suction an end portion of the tape cut with the cutter to prevent meandering of the tape, said suction means being disposed above a stretched path of the tape traveling from one of the route changing rollers standing by in the feed position to the backup roller.

9. A tear tape changing method wherein transfer paths of tapes with cutters disposed therein are formed downstream of two tape reels mounted removably, a backup roller for conducting the tape fed from one of the transfer paths and a packaging film fed along a film feed path to a downstream side in a superimposed state, and a pressure roller for removably holding a front end portion of the tape fed from the other transfer path and causing it to stand by, are disposed on downstream sides of the transfer paths, and when the tape from one of the transfer paths has been used up, the pressure roller and the backup roller are moved close to each other in accordance with a detected value of a residual amount of the tape to connect the other tape which is standing by to the one tape, thus allowing the tape to be fed to the film feed path successively in an alternate manner, said method comprising the steps of:

stretching the tape which is standing by from one of guide rollers, the guide rollers being disposed at downstream ends of the two transfer paths, respectively, and displaced from each other in the front and rear direction orthogonal to the tape feed direction, toward the pressure roller via a route changing roller which is standing by in a stand-by position, and stretching the tape which is in use from the other guide roller toward the backup roller via a route changing roller which is standing by in a feed position, to prevent interference of both tapes even in a crosswise stretched state;

allowing the tape stretched on the route changing roller which is standing by in the stand-by position to be fed to the backup roller with an approaching motion of the pressure roller with respect to the backup roller in accordance with a detected value of a residual amount of the tape which is in use;

thereafter moving the route changing roller in the stand-by position to the feed position by a drive unit and at the same time moving the route changing roller which is standing by in the feed position and which is in an empty state in a rear direction by a relief means while moving the same to the stand-by position by the drive unit, thereby allowing the empty route changing roller to return to the stand-by position without interference with the tape which is stretched on the other route changing roller and which is in use, thus permitting the tape for replacement to be stretched on the pressure roller.

10. A tear tape changing method according to claim 9, wherein said drive unit causes the two route changing rollers to move rotatively.

11. A tear tape changing method according to claim 10, wherein said drive unit causes the route changing rollers to move rotatively in the tape feed direction after the tape which had been standing by was delivered downstream of the backup roller with an approaching motion of the pressure roller and the backup roller.

* * * * *